US009057503B2

(12) United States Patent
Catalano

(10) Patent No.: US 9,057,503 B2
(45) Date of Patent: Jun. 16, 2015

(54) LIGHT-EMITTING DIODE LIGHT BULB GENERATING DIRECT AND DECORATIVE ILLUMINATION

(71) Applicant: Anthony Catalano, Boulder, CO (US)

(72) Inventor: Anthony Catalano, Boulder, CO (US)

(73) Assignee: TERRALUX, INC., Longmont, CO (US)

( * ) Notice: Subject to any disclaimer, the term of this patent is extended or adjusted under 35 U.S.C. 154(b) by 144 days.

(21) Appl. No.: 13/785,078

(22) Filed: Mar. 5, 2013

(65) Prior Publication Data

US 2014/0254154 A1 Sep. 11, 2014

(51) Int. Cl.

| | |
|---|---|
| ***F21V 13/10*** | (2006.01) |
| ***F21V 13/04*** | (2006.01) |
| ***F21K 99/00*** | (2010.01) |
| ***F21V 7/00*** | (2006.01) |

(52) U.S. Cl.

CPC ..... *F21V 13/10* (2013.01); *F21V 13/04* (2013.01); *F21K 9/137* (2013.01); *F21V 7/0016* (2013.01)

(58) Field of Classification Search

CPC ..... F21V 13/034
USPC ..... 362/230, 231, 234, 236, 238, 241–247
See application file for complete search history.

(56) References Cited

U.S. PATENT DOCUMENTS

| | | | | |
|---|---|---|---|---|
| 1,790,179 | A * | 1/1931 | Symmes | 362/305 |
| 5,749,646 | A * | 5/1998 | Brittell | 362/231 |
| 7,367,692 | B2 * | 5/2008 | Maxik | 362/307 |
| 2005/0243552 | A1 | 11/2005 | Maxik | |
| 2006/0012997 | A1 | 1/2006 | Catalano et al. | |
| 2008/0024070 | A1 | 1/2008 | Catalano et al. | |
| 2009/0309501 | A1 | 12/2009 | Catalano et al. | |
| 2011/0260647 | A1 | 10/2011 | Catalano et al. | |
| 2012/0056542 | A1 * | 3/2012 | Hu | 315/113 |
| 2012/0056557 | A1 | 3/2012 | Li et al. | |
| 2012/0112661 | A1 | 5/2012 | van de Ven et al. | |
| 2012/0120649 | A1 | 5/2012 | Catalano et al. | |
| 2012/0134133 | A1 * | 5/2012 | Kang | 362/84 |
| 2012/0134150 | A1 | 5/2012 | Catalano et al. | |
| 2013/0235582 | A1 * | 9/2013 | Breidenassel et al. | 362/241 |

FOREIGN PATENT DOCUMENTS

| | | | |
|---|---|---|---|
| JP | 2005-310561 | A | 11/2005 |
| WO | 2012/148585 | A1 | 11/2012 |
| WO | 2014/138163 | A1 | 9/2014 |

OTHER PUBLICATIONS

PCT International Application No. PCT/US2014/020543, International Search Report and Written Opinion mailed Jul. 24, 2014, 9 pages.

* cited by examiner

*Primary Examiner* — Julie Bannan
(74) *Attorney, Agent, or Firm* — Morgan, Lewis & Bockius LLP

(57) ABSTRACT

In various embodiments, an illumination device includes a primary light source for providing direct illumination, a secondary light source for providing decorative illumination, and a housing having reflective and transmissive regions.

23 Claims, 4 Drawing Sheets

LIGHT-EMITTING DIODE LIGHT BULB GENERATING DIRECT AND DECORATIVE ILLUMINATION

TECHNICAL FIELD

In various embodiments, the present invention relates generally to illumination systems and methods incorporating light emitting diodes (LEDs), and more specifically to such systems and methods that provide both direct illumination and decorative illumination.

BACKGROUND

Halogen light bulbs such as the MR-16 bulb are designed to produce a collimated beam of light via a parabolic reflector. Because halogen bulbs generate considerable energy in the infrared portion of the spectrum, it is often desirable to remove that invisible, heat-producing radiation from the primary illuminating beam. Typically this filtering of the infrared light is accomplished via the use of a dichroic parabolic reflector that is designed to transmit much of the infrared light while ideally reflecting and collimating the visible light, thus removing the infrared light from the primary illuminating beam. However, dichroic reflectors are typically imperfect reflectors and thus allow the transmission of a measurable amount of the visible light. In exemplary bulbs, this amount of "lost" transmitted light can amount to 20% of the total light produced by the bulb. Furthermore, this lost light is often not white light, as it acquires a color as a result of the interference properties of the dichroic reflector in the visible range of wavelengths. Red and green color hues are common in this secondary light, which is also referred to herein as "decorative light." The light is also often patterned as a result of the shape of the dichroic reflector, as the glass on which the reflector is formed often has a faceted or otherwise textured surface.

The manufacturers of light fixtures have utilized decorative light in creative ways. For example, in pendant lights, the glass shade surrounding an MR-16 lamp is often illuminated by the light passing through the dichroic reflector, rendering visible the shade's decorative elements. If no such light were present, the entire fixture would be dark, and the attractive features of the fixture would be lost. This lack of decorative light plagues conventional light bulbs based on light-emitting diodes (LEDs). Although LED bulbs are much more energy efficient than halogen bulbs, their use is avoided in many applications because they do not produce decorative illumination.

One challenge in the production of decorative light arises because of the need to conform to the volume envelope of the standard bulb that the LED bulb is replacing. This defining shape restricts the volume envelope into which the numerous components of an LED bulb must fit; these components may include drive electronics, one or more LEDs, a heat sink, and a standard bulb base, leaving little if any room for components designed to provide decorative illumination. Additional constraints include the desire to reproduce the light pattern emitted by the standard halogen or incandescent bulb, as well as the desire to decrease costs.

SUMMARY

Embodiments of the present invention overcome the limitations of halogen or incandescent light sources, and combine their desirable properties with the advantages afforded by LEDs into a unique system. Various embodiments provide direct illumination as well as decorative illumination distinct from the direct illumination. Embodiments of the present invention therefore include an LED-based light emitter (which includes one or more LEDs) for replacing standard incandescent and/or halogen bulbs for a wide variety of purposes. In accordance with various embodiments, lighting systems have enhanced functionality compared to that of conventional incandescent- or halogen-based lighting systems, and typically include a decorative illumination element that provides, e.g., decorative illumination distinct from the direct illumination from the light emitter.

In an aspect, embodiments of the invention feature an illumination device compatible with a standard receptacle for at least one of a halogen light bulb or an incandescent light bulb. The illumination device includes or consists essentially of a primary light source for providing direct illumination, a secondary light source for providing decorative illumination in a direction different from a direction of the direct illumination, and a housing. The primary light source includes or consists essentially of at least one primary light-emitting diode (LED). The secondary light source includes or consists essentially of at least one secondary LED. The housing includes or consists essentially of (i) a base receivable into the standard receptacle, (ii) disposed around at least the secondary light source, a transmissive region for transmitting decorative illumination therethrough, and (iii) disposed around at least the primary light source and joined to the transmissive region, a reflective region for reflecting light transmitted by the primary light source, thereby providing direct illumination. The transmissive region and the reflective region each substantially conform to a portion of an outer envelope of a conventional halogen light bulb or a conventional incandescent light bulb.

Embodiments of the invention may include one or more of the following in any of a variety of combinations. The outer envelope may include or consist essentially of the outer envelope of an MR-16 halogen light bulb. The secondary light source may include or consist essentially of a plurality of secondary LEDs. The illumination device may include, disposed within the reflective region of the housing, a curved reflector having a reflective inner surface and an outer surface that is at least partially transmissive. The outer surface of the curved reflector may be at least partially diffusive. The inner surface of the curved reflector may reflect light transmitted by the primary light source, thereby providing direct illumination. The curved reflector may be positioned to (i) receive light from the primary light source, (ii) at least partially confine the received light between its inner and outer surfaces, and (iii) transmit at least a portion of the received light from at least a portion of the outer surface, thereby providing decorative illumination. The reflective region of the housing may define a plurality of openings for transmitting light received from the outer surface of the curved reflector. The illumination device may include a diffusive ring for (i) receiving light from the curved reflector and (ii) diffusively scattering the received light, thereby providing decorative illumination.

The illumination device may include a tertiary light source for providing decorative illumination in a direction different from a direction of the direct illumination. The tertiary light source may include or consist essentially of at least one tertiary LED (e.g., a plurality of tertiary LEDs). The curved reflector may be positioned to (i) receive light from the tertiary light source, (ii) at least partially confine the received light between its inner and outer surfaces, and (iii) transmit at least a portion of the received light from at least a portion of the outer surface, thereby providing decorative illumination.

The reflective region of the housing may define a plurality of openings for transmitting light received from the outer surface of the curved reflector. The illumination device may include a diffusive ring for (i) receiving light from the curved reflector and (ii) diffusively scattering the received light, thereby providing decorative illumination. The primary light source and tertiary light source may be disposed on a first surface of a substrate disposed within the housing. The secondary light source may be disposed on a second surface of the substrate opposite the first surface. The substrate may include or consist essentially of a printed circuit board. The substrate may include or consist essentially of (i) a first printed circuit board on which the primary light source and tertiary light source are disposed, (ii) a second printed circuit board on which the secondary light source is disposed, and (iii) a heat sink disposed between the first and second printed circuit boards.

The primary light source may be disposed on a first surface of a substrate disposed within the housing. The secondary light source may be disposed on a second surface of the substrate opposite the first surface. The substrate may include or consist essentially of a printed circuit board. The substrate may include or consist essentially of (i) a first printed circuit board on which the primary light source is disposed, (ii) a second printed circuit board on which the secondary light source is disposed, and (iii) a heat sink disposed between the first and second printed circuit boards. The transmissive region of the housing may be configured to (i) receive light from at least a portion of the secondary light source, (ii) confine at least a portion of the received light within a thickness between inner and outer surfaces of the transmissive region, and (iii) transmit at least a portion of the confined light from at least a portion of the outer surface of the transmissive region. The transmissive region of the housing may be translucent. Electrical components may be disposed within the housing and surrounded by the transmissive region of the housing. The secondary light emitter may be configured to provide decorative illumination substantially free of shadows cast by the electrical components. A substrate may be electrically coupled to the base of the housing and disposed within the housing. The electrical components and at least a portion of the secondary light emitter may be disposed on the substrate, which may be different from a substrate on which the primary light emitter is disposed. The direct illumination may be distinct from the decorative illumination in terms of at least one of intensity or color.

In another aspect, embodiments of the invention feature an illumination device including or consisting essentially of a primary light source for providing direct illumination, a secondary light source for providing decorative illumination in a direction different from a direction of the direct illumination, and a housing within which the primary light source and the secondary light source are disposed. The primary light source includes or consists essentially of at least one primary light-emitting diode (LED) and the secondary light source includes or consists essentially of at least one secondary LED. The housing includes or consists essentially of a transmissive region for transmitting decorative illumination therethrough and a reflective region for reflecting light transmitted by the primary light source, thereby providing direct illumination. The transmissive region is disposed around at least the secondary light source, and the reflective region is joined to the transmissive region and disposed around at least the primary light source. The housing may include a base for providing electrical connectivity between the primary and secondary light sources and an external power source. Embodiments of the invention may include any of the above-listed features in any of a variety of different combinations.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. As used herein, the terms "substantially" and "approximately" mean±10%, and, in some embodiments, ±5%. The term "consists essentially of" means excluding other materials that contribute to function, unless otherwise defined herein. Nonetheless, such other materials may be present, collectively or individually, in trace amounts. Unless otherwise indicated, herein the terms "envelope," "shell," "housing," and "shade" are utilized interchangeably.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawing, in which.

DETAILED DESCRIPTION

Figure 1A:
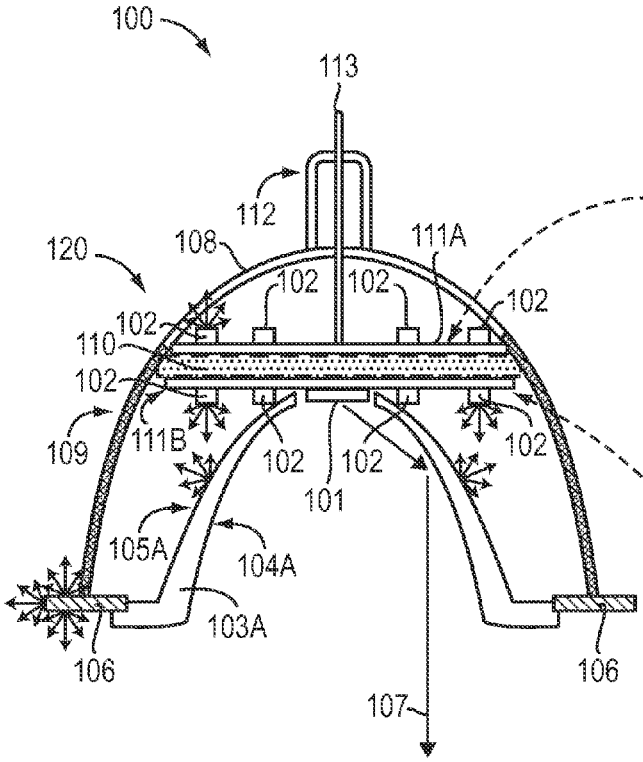
FIG. 1A is a schematic cross-section of an illumination device in accordance with various embodiments of the invention.

FIG. 1 depicts an illumination device 100 in accordance with various embodiments of the present invention. The illumination device 100 includes a conventional bulb base 112 and one or more pins 113 with a standard diameter and spacing. In other embodiments, base 112 includes a screw-in connector with threads of standard size and spacing. Via base 112, illumination device 100 may be inserted into lamps or luminaires as a direct replacement to conventional incandescent or halogen bulbs. The illumination device 100 has an outer shell 120 that preferably has a shape corresponding to or approximating at least a portion (or even all) of the shape of, e.g., an incandescent or halogen bulb being replaced. As shown, the outer shell (or "housing" or "envelope" or "shade") 120 of illumination device 100 may include or consist essentially of multiple distinct regions. For example, as shown, shell 120 may include a metallic and/or reflective region 109 that may act as a heat sink, i.e., exchange heat generated inside illumination device 100 into to the surrounding ambient via convection and/or conduction (and may thus be referred to as "heat sink 109" herein). Generally the heat sink 109 opaque and includes or consists essentially of one or more metals. In various embodiments, the heat sink 109 includes projections (e.g., fins), to facilitate heat conduction via increased surface area, and/or openings therethrough that allow passage of air for cooling. Such openings may also enable the emission of decorative light from the illumination device 100 in a pattern determined by the pattern of openings.

In the embodiment of FIG. 1A, decorative light is generated by one or more LEDs 102 that generally individually generate less light, are smaller in size, and consume less power than one or more main LEDs 101 that provide at least a portion of the light used for direct illumination. The decorative illumination is distinct from and complements the direct illumination from the illumination device 100. For example, the decorative illumination may be different from the direct illumination at least in terms of illumination direction, color, and/or intensity. The LED 101 may be mounted on, e.g., a printed circuit board (PCB) 111B that also serves as a platform for the LEDs 102 that produce the decorative light. In various embodiments of the invention, the decorative illumination is produced via a specially designed reflector 103A. The reflector 103A has an inner surface 104A that is reflective to the light produced by the LED 101 and/or the LEDs 102. For example, the inner surface 104A may be metallized with aluminum or other highly reflecting coating. The inner surface 104A is typically parabolic, and light emitted from LED 101 is collimated to form a direct illumination light beam 107 of a desired angular distribution. The reflector 103A also has an outer surface 105A that has a different shape and surface finish intended to facilitate the formation of the decorative light. As shown in FIG. 1A, the decorative LEDs 102 typically emit a Lambertian distribution of light (indicated by the cluster of arrows) that impinges on the outer surface 105A of the reflector 103A. The outer surface 105A may be faceted or may contain patterning and/or coloration that determines, at least in part, the pattern (if any) of the light reflected from the outer surface 105A. For example, the outer surface 105 may include or consist essentially of a diffuse reflector that distributes the light over a wide range of angles, resulting in decorative illumination of, e.g., the surrounding light fixture in which the illumination device 100 is placed. Thus, the reflector 103A simultaneously produces direct illumination via the one or more primary LEDs 101 and decorative illumination via LEDs 102. The outer and inner shapes and/or surface finish collectively create the desired overall illumination effect.

Figure 1B:
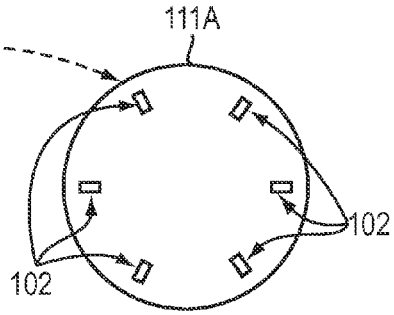
FIGS. 1B and 1C are plan views of components of the illumination device of FIG. 1A.
Figure 1C:
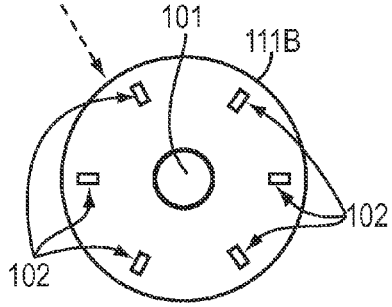

As shown in FIG. 1A, the shell 120 may also include a transmissive region 108 designed to allow light emitted from one or more LEDs 102 (e.g., disposed on a PCB 111A) to exit with minimum absorption. For example, region 108 may be substantially transparent or translucent, and may include or consist essentially of, e.g., glass, a plastic or other polymeric material. Since the drive electronics are typically contained within the portion of illumination device 100 proximate the base 112 (see FIG. 4), in various embodiments it is also desirable to minimize shadow formation from those components and the resulting interference of the decorative illumination emitted from region 108. Thus, the surface of the region 108 may be textured to induce light scattering and thus create the illusion that the light emanates from this surface; effectively light emitted by the LEDs 102 is diffused sufficiently to mask the presence of the light-blocking components inside illumination device 100. As also shown in FIG. 1A, PCB 111A may be joined to a conductive sheet 110 that may also be joined to PCB 111B. In this manner, heat generated by the LEDs 102 on the PCBs 111A, 111B may be conducted away via connection of the conductive sheet 110 to heat sink 109. The conductive sheet may include or consist essentially of, e.g., one or more metallic or other thermally conductive materials. FIG. 1B depicts a plan view of the PCB 111A, and FIG. 1C depicts a plan view of the PCB 111B.

As mentioned above, the outer shell 120 of illumination device 100 preferably has a shape corresponding to or closely approximating at least a portion (or even all) of the shape of, e.g., a conventional incandescent or halogen bulb (e.g., an MR-16 halogen bulb). Specifically, in preferred embodiments of the invention, the transmissive region 108 and the reflective region 109 of shell 120 each substantially conforms to a portion of the outer envelope of the conventional halogen or incandescent bulb. That is, the regions 108, 109 typically collectively approximate (and thus shell 120 approximates) the shape of the conventional bulb, but may do so by defining a slightly different volume and/or form factor that does not deviate from that of the conventional bulb by more than 10%. For example, the shell 120 may approximate curved surfaces of the conventional bulb with planar facets or vice versa. Regardless of such deviations from the exact shape of the conventional bulb, the illumination device 100 still typically fits within sockets or other placement areas designed for the conventional bulb the shape of which it approximates.

In various embodiments, the region 108 may incorporate a phosphor (e.g., a plurality of phosphor particles embedded within the matrix of material forming the region 108) that converts at least a portion of the light emitted by the LED(s) to another wavelength. In such embodiments, the decorative illumination may include or consist essentially of the converted light emitted by the phosphor or of a mixture of the converted light and light transmitted through the region 108 (or an opening therein) without being converted (i.e., "unconverted light"). The phosphor may include or consist essentially of materials such as, e.g., yttrium aluminum garnet and/or other materials known to those of skill in the art and that may be selected for a particular application without undue experimentation. In an exemplary embodiment, an LED emits blue light, a portion of which excites the phosphor to emit yellow light. The yellow light may be utilized as the illumination or may mix with a portion of the unconverted blue light to form white light.

In various embodiments of the invention, the decorative illumination from illumination device 100 is generated or augmented by a diffusive ring 106, which intercepts light from LEDs 102 and/or surface 105A and redistributes it over a wide angle. Ring 106 may include or consist essentially of textured clear plastic so that a portion of the light is scattered from the surface over a wide angle while another portion is trapped and reflected internally and exits via light scattering at the surface. The relative contributions to the decorative illumination generated by region 108, ring 106, and surface 105A may be selected to create a desired overall illumination effect. One or more of the LEDs 102 may emit white light or light of other color(s) depending on the required outcome desired.

Figure 2A:
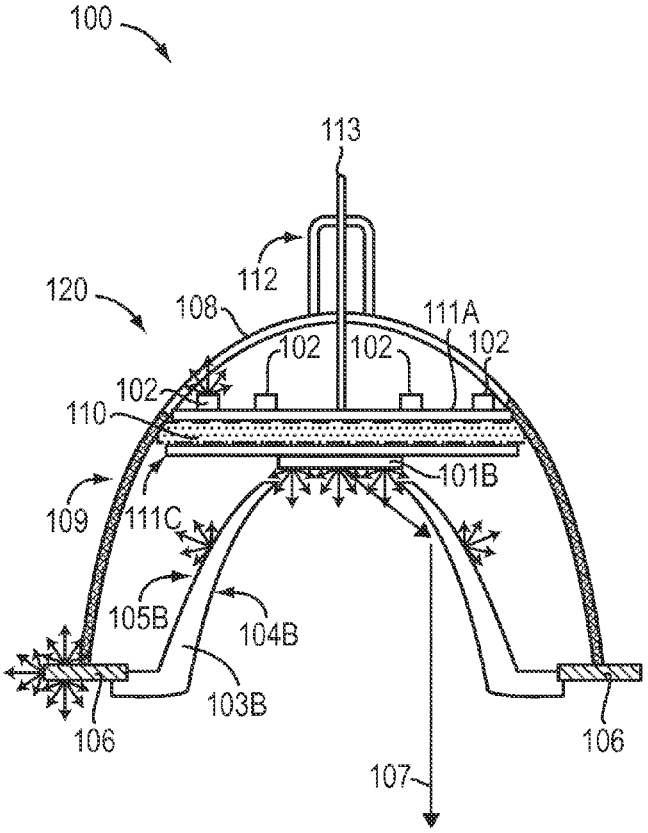
FIG. 2A is a schematic cross-section of an illumination device in accordance with various embodiments of the invention.
Figure 2B:
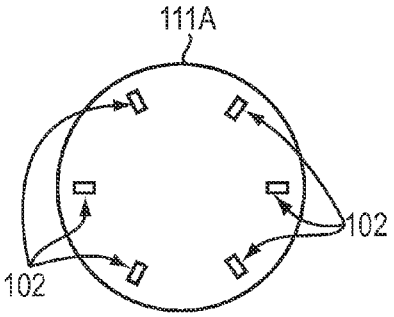
FIGS. 2B and 2C are plan views of components of the illumination device of FIG. 2A.
Figure 2C:
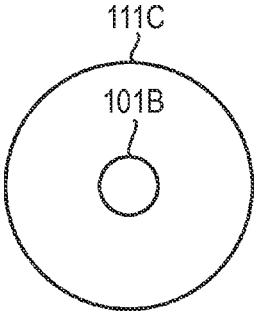
Figure 3:
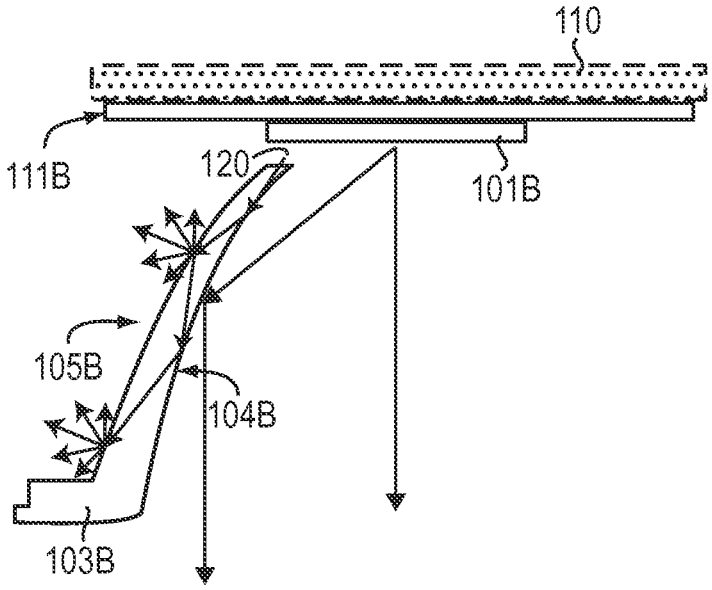
FIG. 3 is an enlarged cross-sectional view of a portion of the illumination device of FIG. 2A.

FIGS. 2A-2C illustrate another embodiment of the invention in which at least a portion of the decorative illumination is generated by the same LED(s) 101B responsible for generating the direct illumination light beam 107. As shown, the LED 101B is disposed on a PCB 111C or other substrate, and a portion of the light emitted by the LED 101B strikes an inner surface 104B of a reflector 103B, thereby forming the direct illumination as detailed above. In addition, a portion of the light emitted by the LED 101B is directed into reflector 103B via edge or facet 120 (FIG. 3), where it is at least partially confined by total internal reflection at the interface between an inner surface 105B and the ambient air. The inner surface 105 typically includes one or more optical elements for extracting the light from reflector 103B, e.g., an embossed pattern of dots or other features. In this manner, at least a portion of the decorative illumination emitted by illumination device 100 is emitted along the length of the reflector 103B. As shown in FIGS. 2B and 2C, in such embodiments the PCB 111C may only serve as a platform for the primary LED(s) 101B, and decorative LEDs 102 may only be present on PCB 111A.

Figure 4A:
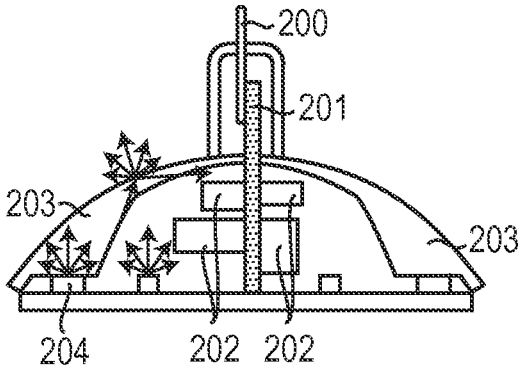
FIGS. 4A and 4B are schematic cross-sections of illumination devices in accordance with various embodiments of the invention.
Figure 4B:
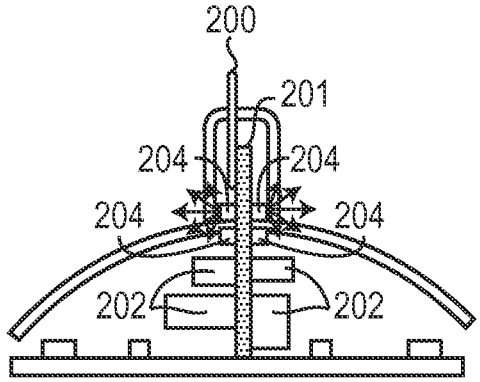

In various embodiments of the invention, total internal reflection may also be utilized to direct decorative illumination within and from region 108 (and the portion of illumination device 100 proximate the base 112), as shown in FIGS. 4A and 4B (in which only the portion of illumination device 100 proximate the base 112 is shown for clarity). In FIG. 4A, the region 108 of shell 120 is replaced with a region 203 in which light from one or more (or even all) decorative LEDs 204 is at least partially confined and propagated via total internal reflection. The LEDs 204 may be optically coupled to the region 203; for example, the LEDs 204 may be joined to an edge or facet of region 203 via an index-matching encapsulant. In this manner, light from the LEDs 204 may be emitted along the surface of region 203 without being shadowed by components 202 (e.g., drive electronics that may include, for example large capacitors and/or inductors) within the illumination device 100. The components 202 may be mounted on a PCB 201 that may also block light not directed into region 203. As shown, a conductive pin 200 (or other standard interface or base) is typically electrically coupled to PCB 201.

In another embodiment, depicted in FIG. 4B, the decorative LEDs 204 may be mounted on PCB 201 along with the components 202. Such embodiments may approximate the decorative illumination effect produced by a conventional halogen MR-16 light bulb. In various embodiments, the LEDs 204 (and/or LEDs 102) draw relatively low operating power, e.g., 0.5 W or less, and emit relatively low intensities of light, e.g., approximately 100 lumens or less. Thus, the placement of one or more LEDs 204 on the PCB 201 may result in relatively little additional heat production; however, in some embodiments, PCB 201 may have a metal core to facilitate heat conduction from the LEDs 204 and the components 202.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. An illumination device comprising:

a primary light source for providing direct illumination, the primary light source comprising at least one primary light-emitting diode (LED);

a secondary light source for providing decorative illumination in a direction different from a direction of the direct illumination, the secondary light source comprising at least one secondary LED;

a tertiary light source for providing decorative illumination in a direction different from a direction of the direct illumination, the tertiary light source comprising at least one tertiary LED; and a housing within which the primary light source and the secondary light source are disposed, the housing comprising:

a transmissive region disposed around at least the secondary light source, wherein the transmissive region is for transmitting decorative illumination therethrough, and a reflective region disposed around at least the primary light source and joined to the transmissive region, wherein the reflective region is for reflecting light transmitted by the primary light source, thereby providing direct illumination.

2. The illumination device of claim 1, wherein the secondary light source comprises a plurality of secondary LEDs.

3. The illumination device of claim 1, further comprising, disposed within the reflective region of the housing, a curved reflector having a reflective inner surface and an outer surface that is at least partially transmissive (i) is diffusively reflective or (ii) transmits at least a portion of light confined between the inner and outer surfaces of the reflector.

4. The illumination device of claim 3, wherein the inner surface of the curved reflector reflects light transmitted by the primary light source, thereby providing direct illumination.

5. The illumination device of claim 3, wherein the curved reflector is positioned to (i) receive light from the primary light source, (ii) at least partially confine the received light between its inner and outer surfaces, and (iii) transmit at least a portion of the received light from at least a portion of the outer surface, thereby providing decorative illumination.

6. The illumination device of claim 5, wherein the reflective region of the housing defines a plurality of openings for transmitting light received from the outer surface of the curved reflector.

7. The illumination device of claim 5, further comprising a diffusive ring for (i) receiving light from the curved reflector and (ii) diffusively scattering the received light, thereby providing decorative illumination.

8. The illumination device of claim 1, wherein the curved reflector is positioned to (i) receive light from the tertiary light source, (ii) at least partially confine the received light between its inner and outer surfaces, and (iii) transmit at least a portion of the received light from at least a portion of the outer surface, thereby providing decorative illumination.

9. The illumination device of claim 8, wherein the reflective region of the housing defines a plurality of openings for transmitting light received from the outer surface of the curved reflector.

10. The illumination device of claim 8, further comprising a diffusive ring for (i) receiving light from the curved reflector and (ii) diffusively scattering the received light, thereby providing decorative illumination.

11. The illumination device of claim 1, further comprising a substrate disposed within the housing, wherein the primary light source and tertiary light source are disposed on a first surface of the substrate.

12. The illumination device of claim 11, wherein the secondary light source is disposed on a second surface of the substrate opposite the first surface.

13. The illumination device of claim 11, wherein the substrate comprises a printed circuit board.

14. The illumination device of claim 11, wherein the substrate comprises (i) a first printed circuit board on which the primary light source and tertiary light source are disposed, (ii) a second printed circuit board on which the secondary light source is disposed, and (iii) a heat sink disposed between the first and second printed circuit boards.

15. The illumination device of claim 1, further comprising a substrate disposed within the housing, wherein the primary light source is disposed on a first surface of the substrate.

16. The illumination device of claim 15, wherein the secondary light source is disposed on a second surface of the substrate opposite the first surface.

17. The illumination device of claim 15, wherein the substrate comprises a printed circuit board.

18. The illumination device of claim 15, wherein the substrate comprises (i) a first printed circuit board on which the primary light source is disposed, (ii) a second printed circuit board on which the secondary light source is disposed, and (iii) a heat sink disposed between the first and second printed circuit boards.

19. The illumination device of claim 1, wherein the transmissive region of the housing is configured to (i) receive light from at least a portion of the secondary light source, (ii) confine at least a portion of the received light within a thickness between inner and outer surfaces of the transmissive region, and (iii) transmit at least a portion of the confined light from at least a portion of the outer surface of the transmissive region.

20. The illumination device of claim 1, wherein the transmissive region of the housing is translucent.

21. The illumination device of claim 1, further comprising electrical components disposed within the housing and surrounded by the transmissive region of the housing, wherein the secondary light emitter is configured to provide decorative illumination substantially free of shadows cast by the electrical components.

22. The illumination device of claim 21, further comprising a substrate upon which the electrical components and at least a portion of the secondary light emitter are disposed, the substrate being electrically coupled to the base of the housing.

23. The illumination device of claim 1, wherein the direct illumination is distinct from the decorative illumination in terms of at least one of intensity or color.

* * * * *